United States Patent [19]

Mayo

[11] Patent Number: 4,534,475

[45] Date of Patent: Aug. 13, 1985

[54] TRAY STACKING

[75] Inventor: Irving A. Mayo, Douglaston, N.Y.

[73] Assignee: Artistic Desk Pad & Novelty Co., Inc., Bronx, N.Y.

[21] Appl. No.: 475,009

[22] Filed: Mar. 14, 1983

[51] Int. Cl.[3] ..... A47F 3/14

[52] U.S. Cl. ..... 211/126; D19/92

[58] Field of Search ..... 211/126, 10, 11, 183; 220/23.6; 229/DIG. 11; 206/821, 555; D19/92; 24/335, 336

[56] References Cited

U.S. PATENT DOCUMENTS

| | | | |
|---|---|---|---|
| D. 144,450 | 4/1946 | Cohen | D19/92 |
| D. 249,048 | 8/1978 | Drell et al. | D19/92 |
| 1,147,975 | 7/1915 | Ruff | 211/126 |
| 2,235,709 | 3/1941 | Hearn et al. | 211/126 X |
| 3,552,579 | 1/1971 | Simon et al. | 211/126 |
| 4,074,810 | 2/1978 | Juergens et al. | 211/126 X |
| 4,138,015 | 2/1979 | Rabley | 211/126 X |

FOREIGN PATENT DOCUMENTS

| | | | |
|---|---|---|---|
| 1191541 | 4/1965 | Fed. Rep. of Germany | 24/336 |
| 1277184 | 10/1961 | France | 24/336 |

OTHER PUBLICATIONS

1 Page—FIGS. 1-4, German Pat. No. 1,191,541, 4/22/65.

1 Page—FIGS. 1-4, French Pat. No. 602,978, 1/5/26.

1 Page—1 FIG., French Pat. No. 1,277,184, 10/61.

1 Page—FIGS. 1 and 2, English Pat. No. 0612045, 11/48.

1 Page—FIGS. 1-5, Italian Pat. No. 0631702, 1/62.

*Primary Examiner*—J. Franklin Foss

*Assistant Examiner*—Sarah A. Lechok

*Attorney, Agent, or Firm*—Sprung, Horn, Kramer & Woods

[57] ABSTRACT

The present invention provides a means for stacking wooden trays easily and for disassembly. Connecting members are provided on the rear and side walls of the trays to be stacked, slipping onto those walls without nails or glue so they can be disassembled easily. The fronts of the trays are unencumbered so they can be of different shapes as well as of different sizes.

1 Claim, 4 Drawing Figures

TRAY STACKING

The present invention relates to a simple way of stacking office trays of the in-out basket type.

Office trays for the substantially horizontal retention of papers comes in a variety of sizes and heights. For saving space it is desirable to stack one above the other and some means are required to hold them together. The higher quality trays are generally made of wood and are in effect open-topped rectangular boxes. They are joined one above the other by metal struts at the four corners each requiring four nails. It is cumbersome to assemble and disassemble as office needs change and assembly and disassembly mar the finish, leaving nail holes. Moreover, if a stack is desired they must all be of the same size to receive the corner holders.

It is accordingly an object of the present invention to provide means for stacking wooden trays easily, without damage and so that they can readily be disassembled. It is a further object to provide means for stacking a plurality of such trays even if not all are of the same dimensions.

These and other objects and advantages are realized in accordance with the present invention pursuant to which there is provided a connecting member comprising a substantially vertical riser, first and second vertically spaced substantially horizontal elements projecting from the vertical riser and a wall element on each of said horizontal elements, the wall elements projecting away from each other, each wall element defining with the vertical riser a tapered channel of maximum width at the horizontal element.

Advantageously the lower wall element is longer than the upper wall element. For example the lower wall element may be about ⅝inch high and at its lower end be at the same elevation as the bottom of the vertical riser. The upper wall element also starts about ⅝inch from the top of the vertical riser but is only about 3/16 inch in height, terminating in an inwardly projecting lip.

The entire member is desirably molded of a substantially rigid plastic like polypropylene, polystyrene or acrylonitrile-butadlene-styrene so that it will keep its shape but it is thin enough so it can be flexed slightly. Preferably the riser and wall elements are not exactly vertical but are slightly bowed for better gripping action when flexed.

The connecting members are provided on the rear and side walls of the trays to be stacked, just slipping onto those walls without nails or glue so they can be disassembled as easily. The fronts of the trays are unencumbered so they can be of different shapes as well as of different sizes.

The invention will now be described in greater detail with regard to the accompanying drawing wherein.

Figure 1:
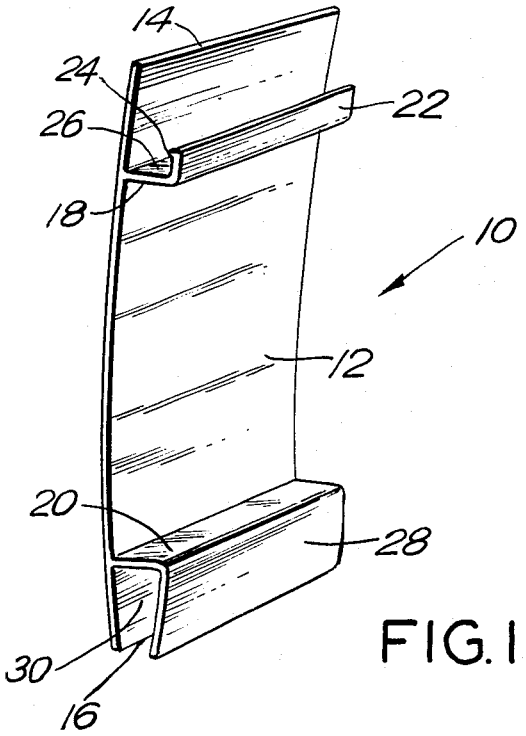
FIG. 1 is a perspective view of a connecting member in accordance with the invention.
Figure 2:
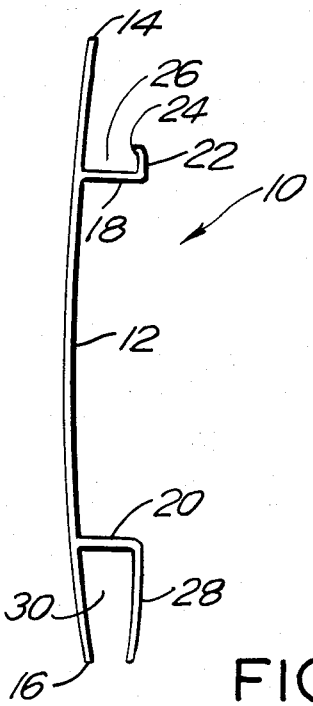
FIG. 2 is a lateral elevation of the connecting member of FIG. 1.

Referring now more particularly to the drawing, in FIGS. 1 and 2 there is shown a connection member 10 integrally molded of relatively stiff plastic. It comprises a relatively thin, e.g. 1/16 inch, substantially vertical riser 12 which at about ⅝inch from its ends 14 and 16 has substantially horizontal elements 18 and 20, respectively. Horizontal element 18 at its outer end carriers an upwardly extending wall element 22 which terminates below end 14 in a lip 24 projecting inwardly of the channel 26 defined between 12 and 22.

Lower horizontal element 20 carries a downwardly extending wall element 28 which terminates at about the same height as end 16, defining therewith a channel 30.

Actually riser 12 and the wall elements 22 and 28 are not perfectly vertical but are bowed slightly so as better to grip the wall of a tray inserted into the channels 26 and 30, as will now be described.

Figure 3:
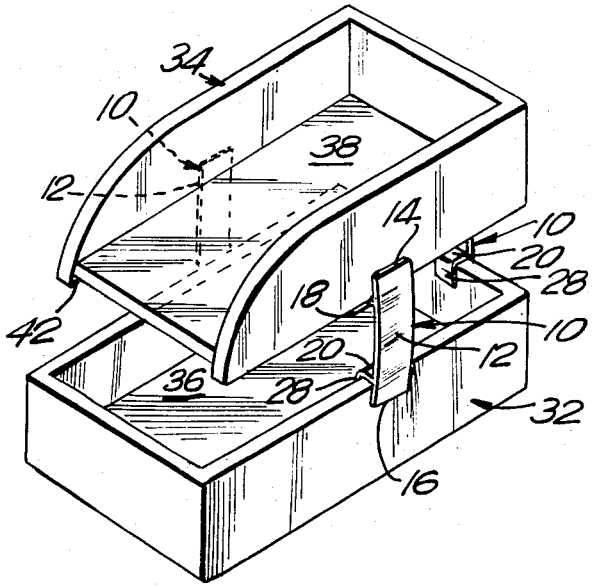
FIG. 3 is a perspective view of two stacked trays held together by three connecting members as in FIG. 1.

In FIG. 3 two dissimilar trays are stacked employing three connecting members 10, on their rear and side walls respectively. The lower tray 32 is legal size and is simply an open-topped rectangular parallelopiped box. The upper tray 34 is letter size and has an open mouth and side walls which terminate in a curve.

Figure 4:
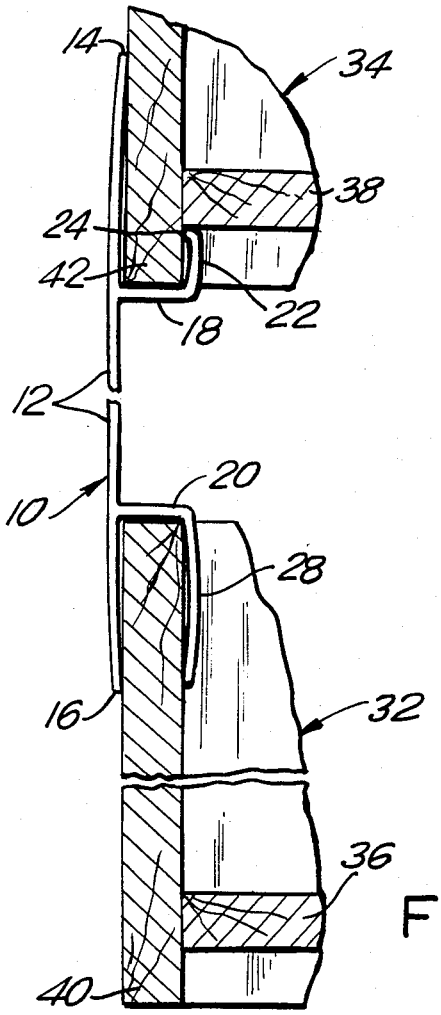
FIG. 4 is a fragmented section showing the manner of connection of the two trays of FIG. 3 by each of the connecting members.

As can be seen in FIG. 4, the wooden trays 32 and 34 have bases 36 and 38 respectively which are slightly higher than their bottoms, i.e. the bottoms of the surrounding walls 40 and 42 respectively. The connecting members grab onto these surrounding walls and clamp them in their channels. The height of wall 22 is designed to the standard height of the base 36 above the bottom of the wall 40 of a standard wooden office tray.

Sometimes a felt fabric is provided on the bottom of a tray in which event it is necessary to peel off such fabric from the bottom of any tray which will be above the lowermost tray.

Obviously more than two trays can be stacked.

It will be understood that the specification and examples are illustrative but not limitative of the present invention and that other embodiments within the spirit and scope of the invention will suggest themselves to those skilled in the art.

What is claimed is:

1. In combination, three members connecting two superposed rectangular trays having vertical walls about at least three sides and a base; each connecting member being integrally molded of a substantially rigid plastic but of a thickness so that it is flexed slightly in assembled state, each connecting member comprising a slightly bowed substantially vertical riser having upper and lower ends and a middle, first and second vertically spaced substantially horizontal elements projecting from the vertical riser near their respective ends and a wall element on each of said horizontal elements, the wall elements projecting away from each other, each wall element defining with the vertical riser a tapered channel of maximum width at the horizontal element, the upper wall element terminating shorter than its riser end and the lower wall element terminating approximately at the same height as its riser end, the upper wall element at its end remote from its horizontal element being provided with a lip projecting inwardly of its channel; the vertical walls of at least the upper tray projecting downwardly below the base, the downward projection of each vertical tray wall being joined to a vertical wall of the tray therebelow by one of said members, the lip of each member engaging the downward vertical wall projection, the thickness of the vertical tray walls being approximately equal to the maximum width of the channels.

* * * * *